United States Patent [19]

Taesler et al.

[11] 4,259,747

[45] Apr. 7, 1981

[54] PROTECTIVE COMMUNICATIONS HELMET

[75] Inventors: Paul F. Taesler, Bonita; John H. Townsend, San Diego, both of Calif.

[73] Assignee: The United States of America as represented by the Secretary of the Navy, Washington, D.C.

[21] Appl. No.: 52,368

[22] Filed: Jun. 27, 1979

[51] Int. Cl.[3] ..... A42B 3/00

[52] U.S. Cl. ..... 2/6; 2/423; 179/156 R

[58] Field of Search ..... 2/6, 10, 410, 414, 415, 2/423, 424, 209, 418; 179/156 R

[56] References Cited

U.S. PATENT DOCUMENTS

| | | | |
|---|---|---|---|
| 2,572,746 | 10/1951 | Mougel | 2/209 |
| 3,673,609 | 7/1972 | De Simone | 2/414 |
| 3,787,894 | 1/1974 | Goodman, Jr. | 2/418 |
| 3,837,005 | 9/1974 | Persson | 2/10 |
| 3,882,547 | 5/1975 | Morgan | 2/414 |
| 4,152,553 | 5/1979 | White | 179/156 R |

FOREIGN PATENT DOCUMENTS

| | | | |
|---|---|---|---|
| 106899 | 9/1924 | Switzerland | 179/156 R |
| 1100749 | 1/1968 | United Kingdom | 179/156 R |

*Primary Examiner*—Peter P. Nerbun

[57] ABSTRACT

A protective communications helmet combining aural, visual, flying object and bump guard protective features with electronic communications including a multiple section shell comprised of a central shell to which lateral electronics compartments are removably attached. The central shell and lateral electronics compartments are of generally planar design for facilitating packaging density and thereby enabling an extremely low center of gravity, reduced moments of inertia, and lower packaging weight. The helmet further includes a suspension system having adjustably secured attenuating, fitting cushions disposed on the inner surface of the central shell and positioned to avoid the Sagittal suture. A nape pad is adjustably secured to the rear portions of the lateral electronics compartment. The helmet is equipped with an externally adjustable universal sizing headband. Mounted on the headband are adjustably fitted side pads and a rear head pad.

Further included in the protective communications helmet is a hearing defender assembly comprised of a single spring to which both hearing defenders are attached. The spring is connected to the central shell of the helmet at the posterior thereof by a hinge mechanism for providing utilization and standby positions.

Additionally, the communications helmet includes a goggle assembly, comprised of a pair of slotted lever arms connected to the central shell at opposite sides thereof to enable utilization and standby positions for protective goggles, a microphone boom and chin cup assembly, all independently operable such that each may be utilized without interference from and without requiring relocation of any of the other items.

46 Claims, 11 Drawing Figures

FIG. 10
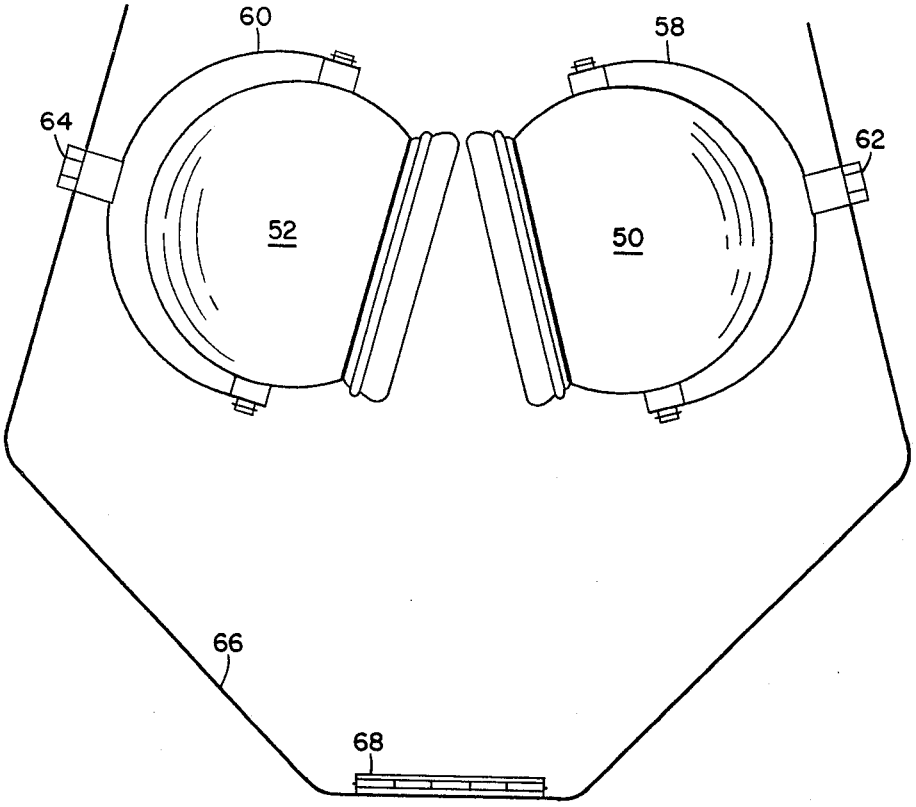
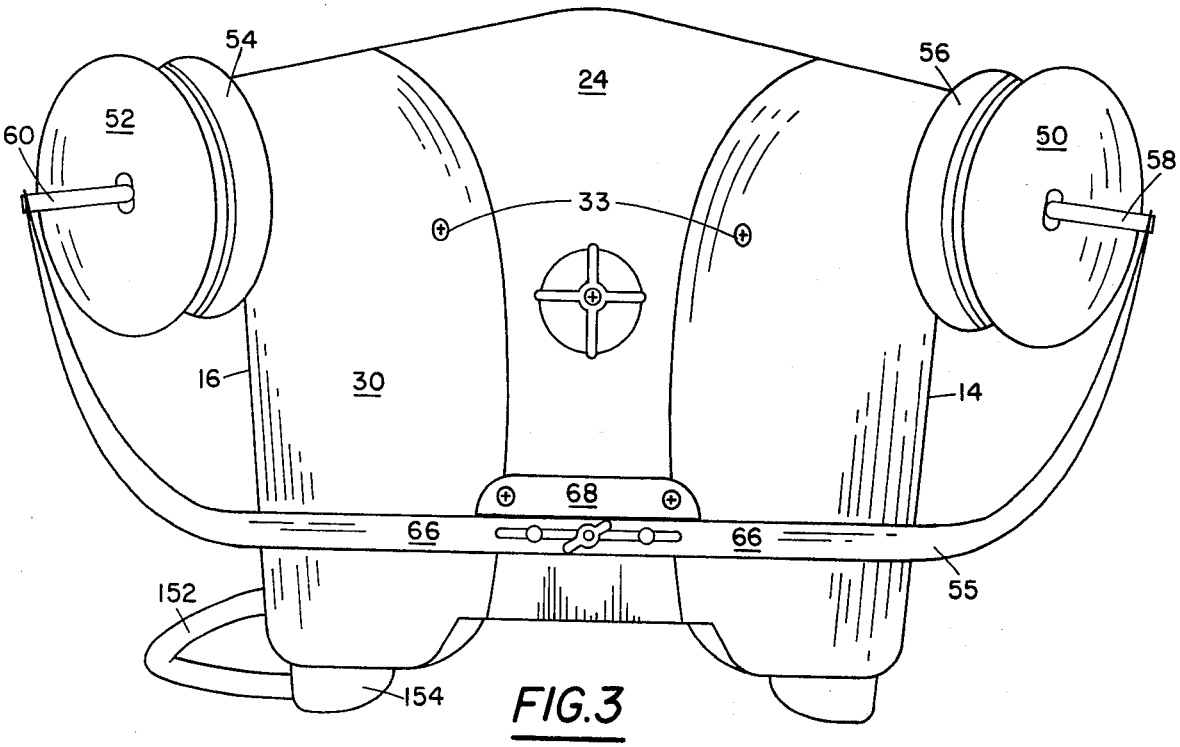
FIG. 3

FIG.5
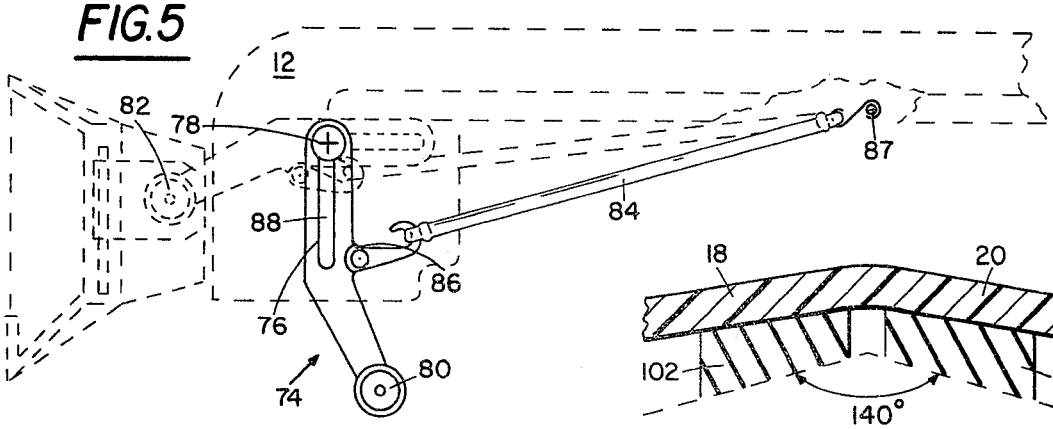
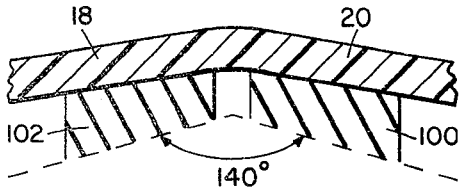
FIG.9
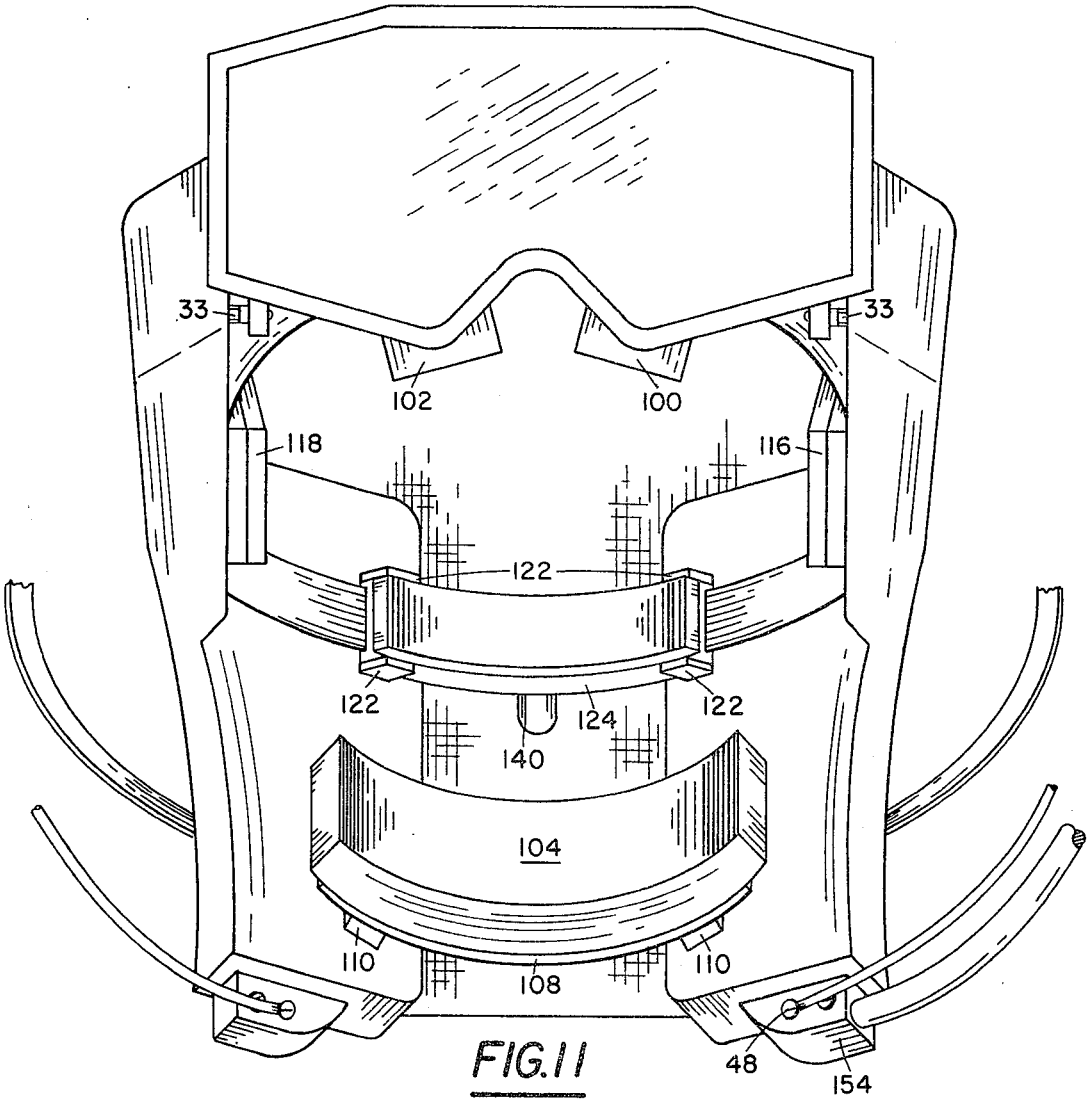
FIG.11

PROTECTIVE COMMUNICATIONS HELMET

BACKGROUND OF THE INVENTION

The present invention relates generally to the field of multi-duty helmets and, particularly, to helmets designed for both the protection of the wearer and for the mounting of auxiliary equipment.

Various types of headgear are presently available for the use of tank, aircraft, mining personnel, etc., such as hard shell helmets designed for the mounting of auxiliary equipment. The large size of these helmets renders them particularly unsuitable for use as communications helmets since the attachment of communications equipment such as transceivers, ear defenders and microphones, in effect, merely add bulk and weight to the already cumbersome helmets. These auxiliary equipments produce excessive pressure on nerves and blood vessels in various areas of the skull and, therefore, are not tolerable by the wearer for any length of time. In general, they are physiologically unsound. This combination of excessive weight and bulk also results in a curtailment of range of movement of the head and neck of the wearer. When the helmets are designed for use in a noisy environment they are usually lined with heavy padding to provide noise attenuation. Actually, the pads limit voice communication without adequately protecting or insulating against high-level noise. A further disadvantage lies in the high cost of these helmets. This is primarily caused by the individual fit required because of the unique size and contour of the particular individual skull. Heretofore the size adjustments have been limited to changing the diameter of a horizontal band, commonly termed a sweat band, going completely around the helmet just inside the helmet opening. The limitation encountered with this design is that while the horizontal diameter of the skull is taken into consideration, no consideration is given to accommodating the individual contour or shape of the skull. Thus, the prior art helmets must be individually fitted which results in a greatly increased cost on a large quantity basis. Another factor adding to the overall cost is the necessity for replacement helmets when an auxiliary equipment attached thereto requires maintenance or adjustment, i.e. the auxiliary equipment is not readily detachable.

An existing communications helmet, the AN/PRC-56 utilized by the U.S. Navy, includes radio electronics contained in the ear pods. This approach suffers from several disadvantages. For instance, the radio enclosure volume is necessarily limited which severely limits the sophistication of radio circuitry. As a result, electronic design compromises are necessitated which make the radio susceptible to damage. Additionally, the radio enclosure is fully exposed to impacts which are encountered in normal use which obviously makes the radio more susceptible to mechanical damage. That design also suffers from the disadvantage that the majority of the radio weight is borne by the headband thus creating a severe pressure point at the top of the user's head, causing discomfort. The fact that the radio is part of the ear pods and is not attached to the helmet suspension system also causes excessive weight moments felt by the user. Moreover, that design has no standby provisions for the hearing defenders or goggles. These items bear heavily on the user's head in use to form an effective seal which is important to the protective features of the helmet. However, there is no way of relieving pressure or eliminating perspiration buildup during stand-down periods short of doffing the entire helmet.

A critical shortcoming of most prior art helmet designs is that they provide no direct means of mounting the goggles. Usually, the goggles are worn with an elastic strap which must pass over the hearing defenders. This, of course, increases the pressure on the head from the hearing defenders.

There are also a wide variety of commercial protective helmets, especially for industrial use, for contact sports and for vehicle sports. Despite this variety, these helmets all require helmet shell sizing (usually as small, medium and large). Furthermore, the shells of these helmets are based on spherical head-shape approximations, they do not combine all the protective features required for a combined high noise, high wind, bump-severe, and flying object environments, they do not lend themselves to integral communications packaging (except in designs that restrict head or body motions) nor can the electronics be easily removed for servicing, and standby provisions for goggles and ear defender assemblies are either limited or non-existent.

Hearing defenders are absolutely required for persons working in high noise environments as around jet aircraft, especially if they must use a communications system as on a flight deck. The hearing defender effectiveness in attenuating noise depends on the design of the hearing defenders, the characteristics of the ear seal, the pressure holding the defenders in place and the ability of the hearing defender to conform to head shape. While hearing defenders are essential in high noise, they are an annoyance in quiet. The hearing defender pressure must be relieved periodically when the use period is beyond an hour or so. Also, hearing defenders cover over the user's head around the ears where there are abundant blood vessels. This means that perspiration is likely to collect inside the hearing defenders, causing irritation. Consequently, a hearing defender standby position is desirable to relieve pressure and perspiration during breaks and standby periods. Hearing defender pressure must be at least two pounds to keep the hearing defenders sealed in the peak ambient noise levels. Noise above 130 dB(c) is capable of vibrating the hearing defender sufficiently to break the seal unless the minimum force is maintained. On the other hand, pressures above 4 pounds are very uncomfortable and cannot be tolerated for very long. The hearing defender mounting system must hold the hearing defenders sufficiently rigid to keep the hearing defenders from sagging off the head under their own weight and under even pressure to force the ear seal to work properly. At the same time, however, the mounting system must be flexible to accommodate head size variations. Some prior art hearing defender mounts include fixed mounts which attach the hearing defenders directly to the helmet with degrees of freedom which allow the hearing defender to conform to head shapes. Other mounting systems provide a linkage between the helmet and the hearing defenders. This linkage usually consists of a spring lever arm and a swivel of some sort on the helmet or a tab mechanism which attaches to the helmet, the hearing defenders and a chin strap. The problems posed by a spring lever arm/swivel design include maintaining mounting pressures within the usable range (2–4 lbs.) across the full range of head variations, establishing a design which does not suffer from fatigue from the stresses in the lever arm, and keeping forces on the helmet below the long-term damage level. The tab mechanism cannot adjust to as wide a range of head sizes as a lever arm, requires the use of a chin strap, and can create locally excessive stresses on the helmet.

Current protective goggles are mounted with an elastic headband. This headband must be worn either inside the helmet, which complicates donning, or outside the helmet, which may interfere with goggle fit and will upset proper hearing defender pressures. In either case there is not normally a full satisfactory standby position for headband mounted goggles. Headband mounted goggles interfere with the normal functioning of other helmet elements because the headband must pass directly above the ears where hearing defenders must seal and suspension system components must rest. Other methods of goggle mount have been attempted, including spring hinges of various sorts and swivel arrangements. These other methods suffer from one or more of the following deficiencies: lack of adjustment range; lack of pressure to hold the goggles in place in high winds and during normal working movements; they require specially designed goggles and they may interfere with the use of eyeglasses. In addition, some of these methods cannot be made rugged enough and are impractical to manufacture in quantity.

SUMMARY OF THE INVENTION

The present invention relates to a communications, protective helmet combining visual, aural and bumpguard protection with communications electronics while overcoming the above described disadvantages associated with prior are helmets. The communications helmet disclosed herein is suitable for use in severe and hazardous environments such as naval flight decks. According to the invention the communications helmet is comprised of a protective central shell that supports the helmet components such as the suspension system, goggle mount and hearing defender assemblies, and one or more detachable compartments for enclosing electronics components and for completing the helmet protective structure. In the preferred embodiment described herein, the protective communications helmet is comprised of a central shell and a pair of lateral electronics enclosures. The lateral electronics enclosures form part of the protective helmet as well as serve to enclose the transmitter-receiver electronics equipment. The central shell and lateral electronics enclosures are designed by the use of planar approximations rather than the spherical or curvelinear design prevalant in prior art helmets. This planar approximation enables efficient packaging of electronics and permits balanced weight distribution as well as freedom in locating the eletronic equipment. This design moreover permits the center of gravity of the helmet to be positioned as low as possible and as close to the head pivot point as is possible, i.e. approximately 1" below and slightly behind the external auditory meatus. Additionally, this planar approximation maximizes electronics packaging deficiencies and simultaneously maintains the weight of the electronics close to the head to reduce moments of inertia and sail area. The electronics compartments are detachably secured to the helmet central shell for enabling easy removal, servicing and/or replacement of the electronics components. Utilization of the electronics enclosures as an integral part of the protective shell serves to minimize the helmet weight. Further, impact shock loads hitting one of the lateral enclosures directly are attenuated by the transfer of energy into the central shell, thus minimizing damage to the electronics.

The protective communication helmet disclosed herein includes a suspension system comprised of six selectively positionable fitting and attenuating pads and a headband that is externally adjustable while the helmet is worn by the wearer. These combined features enable universality of fit with a single shell size. Since the suspension system is contained by the central shell of the helmet, the electronics enclosures are relieved of primary residual stresses. Two of the fitting, attenuating pads are located on the inner surface of the top of the central shell on opposite sides of the Sagittal suture. Since these two top pads bear the major weight and are so disposed as to avoid the Sagittal suture, the pressure from the weight of the helmet is minimized and the least amount of perspiration results due to the absence of blood vessels and nerve endings there. Additionally, the angle formed by the planes of the undersurfaces of the two top pads is approximately 140° thereby approximating the natural angle formed by the two bony plates at the top of the skull resulting in minimization of the load to the head caused by the helmet, and also resulting in lowering of the profile of the helmet as much as possible.

In accordance with the present invention the hearing defenders and associated mounting device combine to provide aural protection from the noise environment. The proper mounting pressure is achieved by a conformal headband which is hinged to the posterior portion of the helmet's central shell. This pressure stays relatively constant over the entire adjustment range because of the long, effective lever arm utilized. The conformal shape of the mounting assembly maintains the helmet profile low and reduces the chance of snagging. Vertical adjustment and standby position are also enabled by this mechanism. Moreover, the hearing defender design disclosed herein results in high reliability and ruggedness without introducing fatiguing stresses in the headband or helmet. Quite importantly, the hearing defender assembly of the present invention has no dependence on the other helmet subsystems such as the chin cup, suspension system or goggle mounts.

The goggle mount assembly of the present invention utilizes an over center principle to achieve two stable goggle positions. It enables a wide range of adjustment with very even loading pressure and does not interfere with the hearing defender assembly, chin cup assembly or the microphone boom. The standby position facilitates donning and doffing. The goggle mount assembly additionally is extremely easy to manufacture, is adaptable to various types of goggles and does not interfere with the use of eyeglasses.

Finally, as with the other subsystems of the protective communications helmet disclosed herein, the microphone boom assembly and the chin cup assembly are independently operable systems that are non-interfering with the other subsystems of the helmet.

OBJECTS OF THE INVENTION

It is therefore a primary object of this invention to provide a helmet utilizing a sturdy lightweight framework for mounting various non-interfering equipments.

Another object is to provide a helmet with a simple size adjustment for universality of fit.

A further object is to provide a helmet whereby the weight and surface area are distributed physiologically and functionally over the head and neck in a manner tolerable for long periods of time by the wearer.

Another purpose of the present invention is to provide a helmet with as low a center of gravity as possible and that is as close to the head pivot point as possible to thereby minimize the natural torques and moments of inertia about the head pivot point and to thereby maximize wearing time.

Still another object is to provide an ambient noise attenuating helmet capable of mounting hearing defenders.

A further object is to disclose a protective communications helmet including a hearing defender assembly and a goggle assembly which are non-interfering.

Yet a further object is to provide a helmet for the mounting of intercommunications equipment which may include a transmitter, a receiver, a battery pack and coding and decoding modules whereby the electronics compartments form part of the protective structure of the helmet and are easily detachable for servicing, adjustment and replacement of the enclosed electronics.

Other objects, advantages and novel features of the invention will become apparent from the following detailed description of the invention when considered in conjunction with the accompanying drawings.

BRIEF DESCRIPTION OF THE DRAWINGS

FIG. 3 is a posterior view of the protective communications helmet of the present invention illustrating the hearing defenders in their standby condition.

FIG. 5 is a side view of the central shell and goggle mount assembly with the electronics compartments removed. The goggle mount assembly standby position is shown in phantom.

FIG. 9 is a front view cross-section of the helmet top pads illustrating in dotted lines the angle formed by the planes of the undersurfaces of said pads.

FIG. 10 is a top view of the hearing defender assembly removed from the protective helmet.

FIG. 11 is a front view of the helmet interior components.

DESCRIPTION OF THE PREFERRED EMBODIMENT

Figure 1:
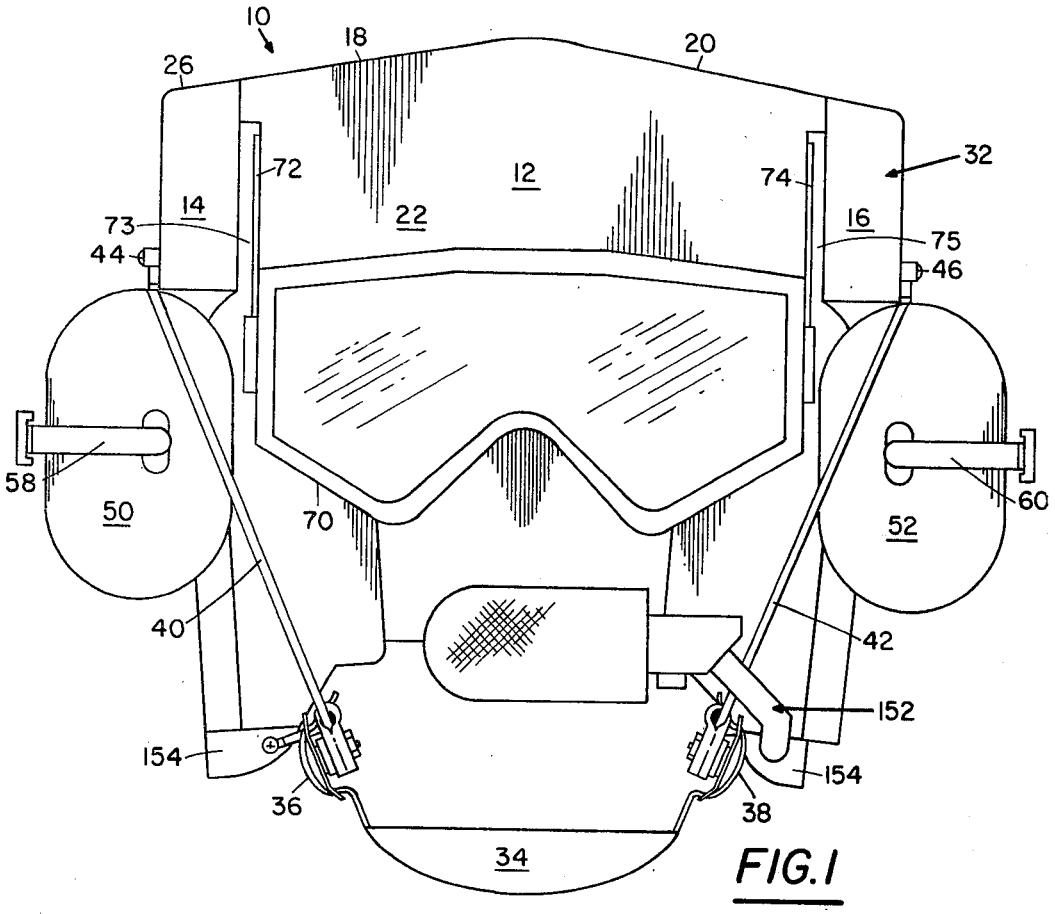
FIG. 1 is a front view of the protective communications helmet of the present invention.
Figure 2:
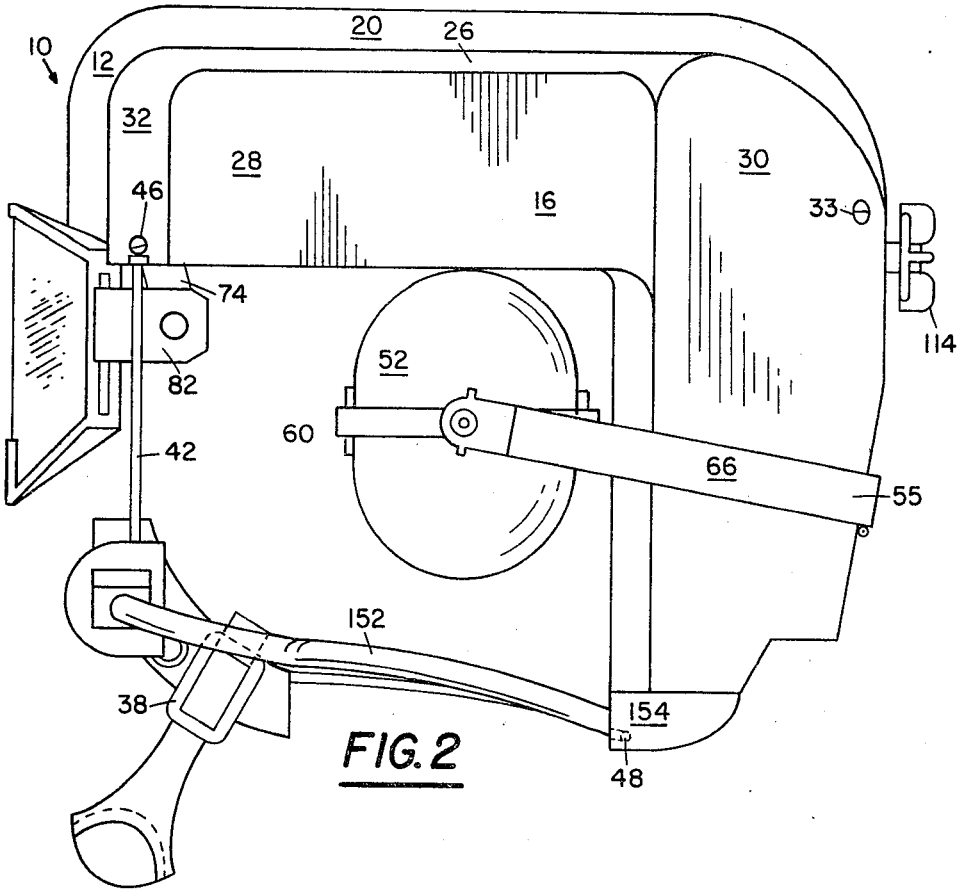
FIG. 2 is a left side view of the protective communications helmet of the present invention.

Referring now to the drawings and particularly to FIGS. 1 to 3 a general description of the present invention will be given followed by a more detailed description of the individual features. FIGS. 1 to 3 illustrate a preferred embodiment of the protective communications helmet 10 comprised basically of a central shell 12 and lateral enclosures 14 and 16 which contain the electronic components. In the preferred embodiment the shell dimensions are such as to allow the fit of a 99th percentile human head, based primarily on MIL-HDBK-759 anthropometric data. The shell contours are planar approximations to the nominal human head shape. Particularly, the central shell portion 12 includes a first planar section 18 and a second planar section 20 joined along the axis of symmetry of the helmet. The central shell 12 also includes a front section 22 which extends from the planar sections 18 and 20 downward over the forehead of the wearer and a rear section 24 which extends from the planar sections 18 and 20 downward over the posterior of the head and neck of the wearer. Likewise, the lateral enclosure 16 has a top planar surface 26, a side planar surface 28, a rearward planar surface 30 and a forward planar surface 32. Lateral enclosure 14 has identical but opposite planar surfaces. These planar approximations create flat surfaces for the enclosure of electronics components maximizing packaging density capabilities and simultaneously keeping the electronics weight close to the head to reduce moments of inertia and sail area. The contours of the helmet are smooth at the junctures of the planar surfaces to reduce wind resistance. The lateral electronics enclosures 14 and 16 are secured to the central shell 12 as by (captive) screws or quick-disconnect studs 33 at forward and aft left and right locations. Thus, the electronics enclosures 14 and 16 can be easily removed from the central shell 12 for servicing or replacement of the contained electronics. The planar areas described above reduce shocks from dropping the helmet to the electronics since the edges, the most likely strike points, are not directly connected to the internal electronics and since the planar surfaces distribute the shock energy. The central shell 12 contains the mounting provisions for the helmet-essential suspension system items, the hearing defenders, and the goggle assemblies to be described below. Thus, the electronics enclosures 14 and 16 are relieved of primary residual stresses and may be maintained as separate entities when desired. The central shell 12 is preferably laid up and molded in fiberglass or Kevlar or similar material but may also be injection molded or vacuum-formed in a plastic such as polycarbonate or ABS depending on the material characteristics needed for the particular application and on the quantities produced. The electronics enclosures 14 and 16 may be formed out of any suitable material. However, ABS or glass-filled ABS plastic is most attractive because it can be readily plated for EMI protection of the electronics and it has good strength. Thus, a great deal of electronics design sophistication and flexibility can be accommodated by the protective communications helmet 10.

The chin cup 34 fastens by suitable means such as snap loops 36 and 38 which are slidably engaged with two suspension cord members 40 and 42, respectively. The suspension cord members 40 and 42 are secured to their respective electronics enclosures 14 and 16 at the front portions thereof by suitable means such as screws 44 and 46, respectively, and at the aft portions thereof by screw member 48 on the electronics enclosure 16 and an identical screw member (not shown) on the aft portion of the electronics enclosure 14. The chin cup 34 is preferably of leather for comfort. The chin cup 34 keeps the helmet stable during violent activity and keeps jet blasts from blowing the helmet 10 off. Adjustment is provided to allow sizing.

The hearing defenders 50 and 52 and the associated mounting assembly 55 combine to provide aural protection from the particular noise environment involved.

The hearing defenders 50 and 52 and their respective ear seals 54 and 56 are selected to provide the required amount of acoustic attenuation. The attenuation must be derated when earphones are used inside the hearing defenders. The hearing defender mounting device 55 applies pressure to the hearing defenders 50 and 52 to effect a proper seal against the head. This pressure must be maintained between two and four pounds force of load. The mounting device 55 consists of stirrups 58 and 60 connected to the respective hearing defenders 50 and 52 (see FIG. 10), a pair of slide swivels 62 and 64, a conformal band 66 and a hinge 68. The stirrups 58 and 60 and the slide swivels 62 and 64 allow the hearing defenders 50 and 52 to pivot and adjust to ear location and head contours. The conformal band 66 maintains the proper spring tension for hearing defender loading. The unique conformal shape of the band 66 is necessary to reduce the probability of snags when the protective communications helmet 10 is worn around heavy equipment. The long arc of the band 66 allows its spring tension to remain within narrow tolerances despite head breadth variances. As is seen in FIG. 3, the hinge 68 is secured to the central shell 12 and keeps the headband in place on the helmet but allows pivoting the hearing defenders up to the enclosures 14 and 16 as in the standby position illustrated in FIG. 3. This standby position eases donning and doffing the helmet, enables relief from seal pressures and perspiration during standdown times and still allows communication while in a rest position.

The goggles 70 and goggle mounts 72 and 74 provide visual protection. The goggle mount assembly as seen in FIG. 1 extends through apertures 73 and 75 formed between the central shell 12 and the lateral compartments 14 and 16. Any suitable standard goggle configuration can be adapted for use with the protective communications helmet 10 because of the design flexibility allowed by the goggle mounting devices 72 and 74. The goggles can be selected through application requirements. Referring to FIG. 5 there is illustrated the goggle mounting device 74, it being understood that the mounting device 72 (not shown in detail) is identical. The goggle mounting device 74 comprises a slotted lever arm 76 rotatably secured to the helmet front center section 22 by suitable means such as screw 78 and are terminated by a snap member 80. The goggle 70 attaches to the mount assembly 74 through a short nylon web snap strap 82. A bungee cord 84 or other suitable elastic type member attaches to a hook member 86 on the lever arm 76 to provide the loading pressure to keep the goggle 70 seated on the face. The other end of the bungee cord 84 is terminated and secured to the rear of the central shell 12 as by a hook and rivet 87. The length of the bungee cord is designed to keep the loading pressure nearly constant for different head lengths. The slot 88 in the lever arm 76 allows the goggles to be adjusted up and down for comfort and fit. Moreover, the slot 88 enables the goggles 70 to be rotated up and locked into a standby position. This is accomplished by rotating the snap end 80 of the slotted lever arm 76 forward and upward until the slot 88 is approximately in line with the bungee cord 84. At that point the bungee cord 84 will pull the slotted lever arm 76 aft into the standby position as is illustrated in dotted lines. The standby position makes it easier to don and doff the protective communications helmet 10 and allows the user relief from pressure and perspiration during standdown periods. The snap connections 80 and 82 between the goggle 70 and the mount 74 enables a rapid change of goggles. The change of goggles is faster than changing lenses when going from day to night lighting. This mounting approach allows totally independent operation of the goggles from other helmet features, especially the hearing defenders and headband/suspension system to be described below. To return the goggles 70 to the use position, the user pulls the goggles forward until the lever arms 72 and 74 reach the end of the slot 88. The user then rotates the goggles down so that the lever arms pass over the center position into the use position. The tensioning pressure is maintained by the bungee cords 84 which attach to the lever arms and to the helmet. The bungee cords 84 are located so that no interference occurs with any other helmet part.

Referring now to FIGS. 4, 6, 7, 9 and 11 the suspension system will now be described. The suspension system comprises foam islands 100, 102 and 104 plus the adjustable headband subassembly. The foam islands 100 and 102 are secured to the helmet's central section 12 by means of Velcro attachment systems (not shown) comprising hooks and loops as is well known. The foam islands 100 and 102 are so positioned at the top of the helmet on opposite sides of the Sagittal skull suture so as to avoid that suture. The pads 100 and 102 are connected by suitable material 106 to maintain their separation distance so that if they are removed to be adapted to the head of the user they will neither be separated nor moved closer to each other. Nape pad 104 is also removably attached to the electronics enclosures 14 and 16 via a mounting bracket 108 having a Velcro member attached to the inner side thereof (not shown). Similarly, the Velcro counterpart (either hooks or loops) is affixed to the electronic enclosures 14 and 16 along support struts 110. In this manner the nape pad 104 is readily removable from the struts 110 formed on the aft portions of the electronics enclosures 14 and 16. The headband 112 is adjustable externally from the back of the central shelf 12 by an adjustment knob 114. Fitting, attenuating side pads 116 and 118 are secured to the headband 112 also by means of Velcro, and a wool chamois 120 is snapped around the forehead part of the headband 112. The headband 112, as seen in FIG. 11 passes through the guides 122 and retaining sleeve 124. Affixed to the retaining sleeve 124 by a Velcro attachment system (not shown) is the posterior head pad 126. The pads 116, 118 and 126 prevent excessive pressure points from occurring around the headband and the chamois 120 keeps perspiration from running down into the goggles 70 and minimizes headband irritations. The entire suspension system is laid out so that the skull sutures are avoided, weight is well distributed into the least sensitive head areas and blood vessel and nerve ending concentrations are avoided. By avoiding blood vessel concentrations, air flow is maximized over the head areas of greatest perspiration. Therefore, perspiration buildup is minimized. The attenuating, fitting islands and pads 100, 102, 116, 118, 126 and 104 are placed to provide helmet stability even if the chin cup 34 is not in use. Referring to FIG. 9 it is seen that the planar undersurfaces of the pads 100 and 102 form an angle of approximately 140° to lower the helmet 10 profile and minimize loading to the head. Stabilizing tabs 128 and 130 are attached to each side of the forehead section of the headband 112 from the central shell 12 by means of screws or rivets. These tabs 128 and 130 together with the headband guides 122 keep the helmet symmetrically located on the head for stability, comfort and in case of impact. Impact energy is attenuated by the foam material of the pads and by the deformation resistance of the headband 112. The headband 112 is specially offset at sections 132 to avoid interference with the hearing defenders 50 and 52.

Figure 8A:
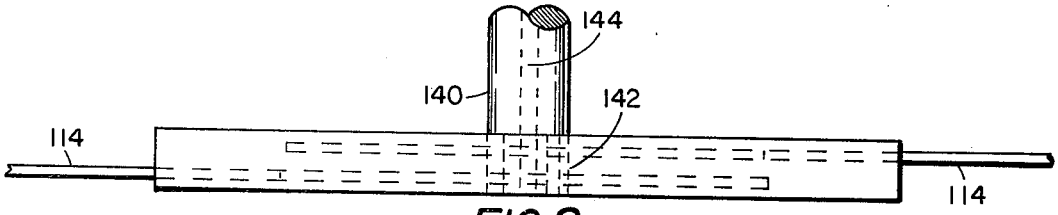
FIG. 8a is a side view of the adjustment mechanism illustrated in FIG. 8.
Figure 8:
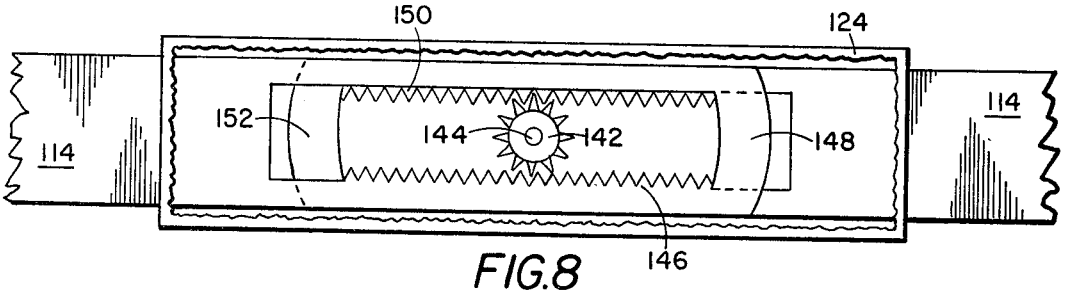
FIG. 8 is a representation of the adjustment mechanism of the headband assembly.
Figure 6:
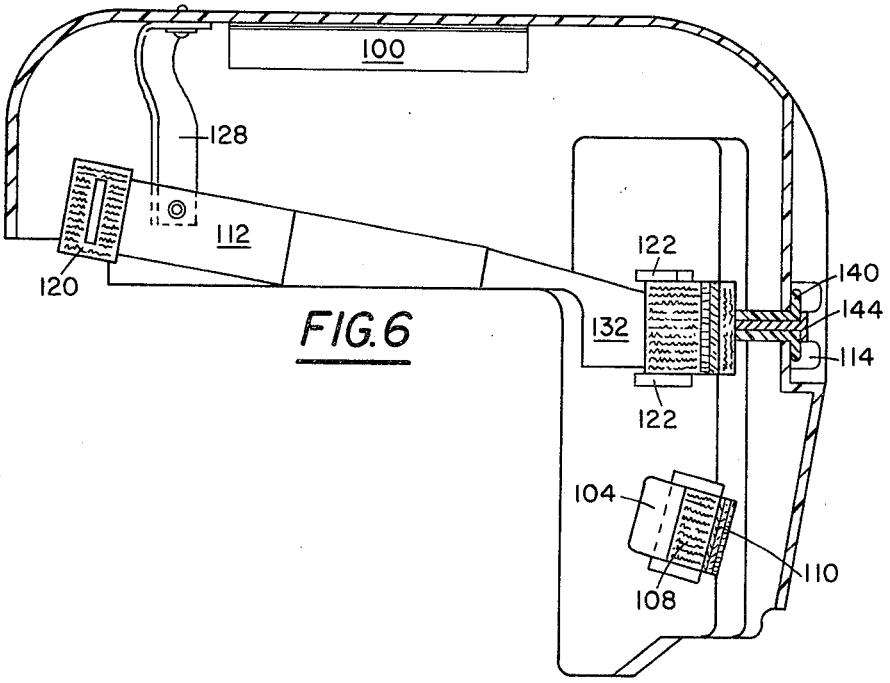
FIG. 6 is a cross section along lines A—A of FIG. 4.
Figure 7:
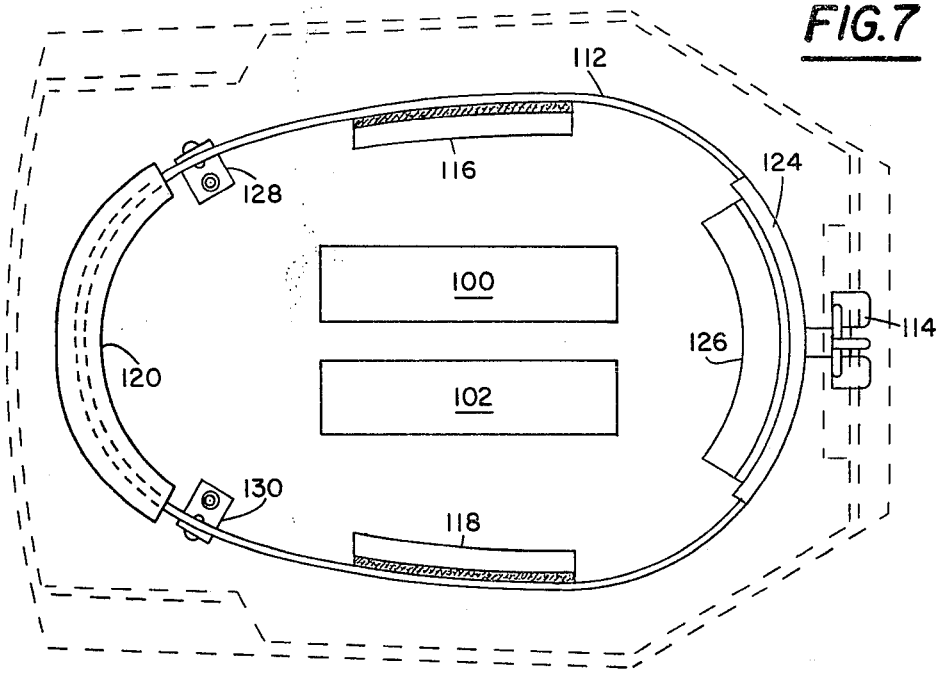
FIG. 7 is a bottom view of the protective communications helmet illustrating the adjustable headband suspension assembly and the island pad system.
Figure 4:
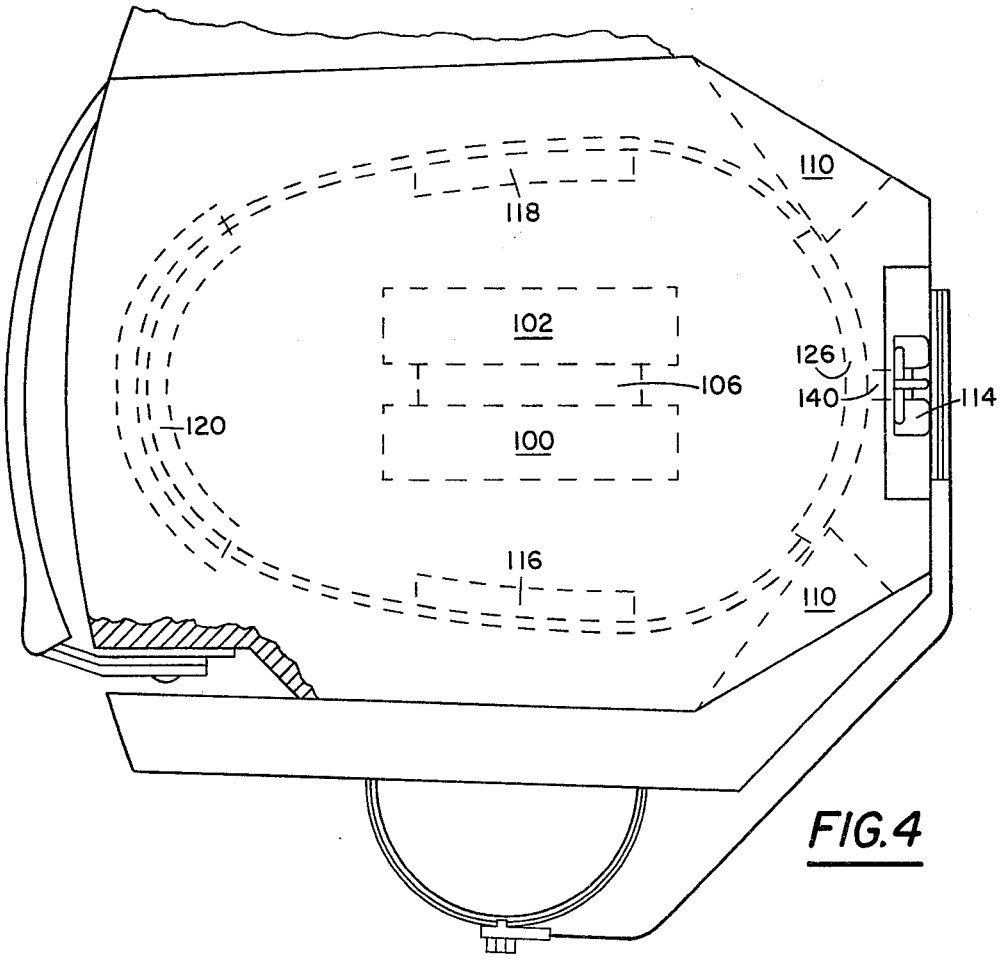
FIG. 4 is a top view of the protective communications helmet of the present invention illustrating in dotted line the adjustable headband suspension system.

Once the protective communications helmet 10 is donned by the wearer the headband 112 is adjusted externally via the adjustment knob 114. Referring to FIGS. 6, 8 and 8*a* it is seen that adjustment knob 114 is connected by connecting rod 140 to gear 142 by adjustment knob retaining screw 144. Gear 142 engages with gear teeth 146 on the right end 148 of the headband 112 and also with the gear teeth 150 on the left end 152 of the headband 114. It should thus be readily apparent that clockwise rotation of the adjustment knob 114 will cause the headband right end 148 to separate further from the headband left end 152 thereby causing the headband to reduce in size. Likewise, rotation of the adjustment knob 114 in a counter clockwise direction will cause the headband right and left ends 148 and 152, respectively, to approach each other thereby increasing the length and size of the headband 114.

The final element of the protective communications helmet 10 comprises the microphone boom assembly 152, illustrated in FIGS. 1, 2 and 3. The boom assembly 152 is attached to the lateral electronics enclosure 16 at the rear base thereof by a swivel mount 154. In this manner the microphone boom may be pivoted to a utilization position in front of the mouth of the user or to a standby position away from the mouth.

It is to be understood that although the preferred embodiment described herein is directed to a protective communications helmet with detachable lateral electronics compartments, it is within the scope of this invention that these lateral compartments may be permanently affixed to the central shell and/or other helmet portions such as the central shell planar sections 18 or 20, the central shell front section 22 or the rear section 24, may be designed to be electronics compartments, either permanently affixed or detachably secured.

Obviously many modifications and variations of the present invention are possible in the light of the above teachings. It is therefore to be understood that within the scope of the appended claims the invention may be practiced otherwise than as specifically described.

What is claimed is:

1. A protective communications helmet comprising:

a central shell having a top section, a front section and a rear section, said top section comprising first and second generally planar members being joined at the center of said helmet, said front section extending from said top section downward over the anterior of the head of the wearer, and said rear section extending from said top section downward over the posterior of the head of the wearer;

a pair of lateral electronics enclosures each being detachably secured to said central shell at a side of said central shell, each said lateral electronics enclosure having a side portion and a rear portion for protecting the sides and posterior quarters of the head of the wearer, respectively.

2. The helmet of claim 1 further comprising:

a pair of cushions, each being secured to the inner surface of one of said first and second planar members and being positioned to avoid the Sagittal suture of the wearer;

each of said pair of cushions having a substantially planar undersurface such that the angle formed by the planes of both said undersurfaces is approximately 140 degrees.

3. The helmet of claim 2 wherein said cushions are energy attenuating, fitting cushions.

4. The helmet of claim 3 wherein each of said pair of cushions is removably secured to said inner surface of one of said first and second planar members by means for permitting the removal, repositioning and resecuring of said pair of pads.

5. The helmet of claim 3 wherein said permitting means comprises a hook and pile fastener attachment system.

6. The helmet of claim 2 further comprising:

means for connecting said paid of pads together to maintain their separation at a predetermined distance from each other.

7. The helmet of claim 1 further comprising:

a headband secured to the interior of said lateral electronics enclosures and to the interior of said central shell; and means for adjusting the size of said headband from the exterior of said helment while said helmet is being worn.

8. The helmet of claim 7 further comprising:

a pair of cushions, each being secured to the inner surface of one of said first and second planar members and being positioned to avoid the Sagittal suture of the wearer;

each of said pair of cushions having a substantially planar undersurface such that the angle formed by the planes of both said undersurfaces is approximately 140 degrees.

9. The helmet of claim 8 further comprising:

a pair of side cushions secured to said headband along the side portions of said headband for contact with the sides of the head of the wearer;

a rear head cushion secured to said headband along the rear portion thereof; and a nape cushion secured to said pair of lateral enclosures rear portions.

10. The helmet of claim 9 wherein:

said pair of cushions is removably secured to said inner surface of one of said first and second planar members by first means for permitting the removal, repositioning and resecuring of said pair of pads;

said pair of side cushions and said rear head cushion are secured to said headband by second and third means, respectively, for permitting the removal, repositioning and resecuring thereof; and said nape cushion is secured to the rear portions of said pair of lateral enclosures by fourth means for permitting the removal, repositioning and resecuring of said nape cushion.

11. The helmet of claim 10 wherein said first, second, third and fourth means each comprises a Velcro attachment system.

12. The helmet of claim 7 wherein said means for adjusting the size of said headband comprises:

a first row of gear teeth on one end of said headband;

a second row of gear teeth on the other end of said headband;

a gear engaging said first and second rows of gear teeth;

an extension rod connected to said gear and extending through said rear section of said central shell; and an adjustment knob connected to said extension rod at the exterior of said helmet.

13. The helmet of claim 1 wherein said side and rear portions of each said lateral electronics enclosure comprises generally planar members.

14. The helmet of claim 2 wherein said side and rear portions of each said lateral electronics enclosure comprises generally planar members.

15. The helmet of claim 7 wherein said side and rear portions of each said lateral electronics enclosure comprises generally planar members.

16. The helmet of claim 1 further comprising a hearing defender assembly comprising:

a pair of hearing defenders;

spring means connected to said pair of hearing defenders for biasing said hearing defenders towards the ears of the wearer; and hinge means connected to said central shell and to said spring means for enabling selective positioning of said pair of hearing defenders alternatively over the ears of the wearer or at rest against said pair of electronics enclosures or at rest, off of said helmet away from said pair of electronics enclosures so as to permit removal of said pair of electronics enclosures.

17. The helmet of claim 16 wherein said spring means comprises a single curved band.

18. The helmet of claim 17 wherein said single curved band is a metallic band.

19. The helmet of claim 16 wherein said spring means exerts no spring pressure against either said central shell or said pair of electronics enclosures.

20. The helmet of claim 19 wherein said hinge means is connected to said central shell rear section.

21. The helmet of claims 2, 7, 8, 12 or 15 further comprising:

a pair of hearing defenders;

spring means connected to said pair of hearing defenders for biasing said hearing defenders towards the ears of the wearer; and hinge means connected to said central shell and to said spring means for enabling selective positioning of said pair of hearing defenders alternatively over the ears of the wearer or at rest against said pair of electronics enclosures or at rest, off of said helmet away from said pair of electronics enclosures so as to permit removal of said pair of electronics enclosures.

22. The helmet of claim 1 further comprising a goggle assembly comprising:

first and second slotted lever arms coupled to said central shell at opposite sides thereof such that said lever arms are slideable along the lengths of said slots;

first and second elastic means connected to said first and second slotted lever arms, respectively, and to said central shell for biasing said first and second lever arms generally towards the posterior of said central shell; and means for connecting said first and second lever arms to a pair of goggles.

23. The helmet of claim 22 wherein each of said first and second slotted lever arms extends between said central shell and a corresponding one of said pair of lateral enclosures.

24. The helmet of claim 23 wherein said first and second slotted lever arms are selectively positionable between utilization and standby positions and wherein said first and second elastic means exert tension on said goggles to secure said goggles against the face of the wearer when said first and second lever arms are in said utilization position and further wherein said first and second elastic means exert tension on said goggles to secure them against said central shell front section when said first and second lever arms are in said standby position.

25. The helmet of claim 24 wherein each of said first and second elastic means comprises:

a clevis member connected to a respective one of said first and second slotted lever arms; and an elastic cord connected to said clevis member and to said central shell.

26. The helmet of claim 22 wherein said first and second slotted lever arms are coupled to said central shell by first and second mounting pins, respectively, said mounting pins being connected to said central shell and extending through the respective slots of said first and second slotted lever arms such that said first and second slotted lever arms are rotatable about their respective mounting pin.

27. The helmet of claim 2 further comprising:

first and second slotted lever arms coupled to said central shell at opposite sides thereof such that said lever arms are slideable along the lengths of said slots;

first and second elastic means connected to said first and second slotted lever arms, respectively, and to said central shell for biasing said first and second lever arms generally towards the posterior of said central shell; and means for connecting said first and second lever arms to a pair of goggles.

28. The helmet of claim 7 further comprising:

first and second slotted lever arms coupled to said central shell at opposite sides thereof such that said lever arms are slideable along the lengths of said slots;

first and second elastic means connected to said first and second slotted lever arms, respectively, and to said central shell for biasing said first and second lever arms generally towards the posterior of said central shell; and means for connecting said first and second lever arms to a pair of goggles.

29. The helmet of claim 8 further comprising:

first and second slotted lever arms coupled to said central shell at opposite sides thereof such that said lever arms are slideable along the lengths of said slots;

first and second elastic means connected to said first and second slotted lever arms, respectively, and to said central shell for biasing said first and second lever arms generally towards the posterior of said central shell; and means for connecting said first and second lever arms to a pair of goggles.

30. The helmet of claim 12 further comprising:

first and second slotted lever arms coupled to said central shell at opposite sides thereof such that said lever arms are slideable along the lengths of said slots;

first and second elastic means connected to said first and second slotted lever arms, respectively, and to said central shell for biasing said first and second lever arms generally towards the posterior of said central shell; and means for connecting said first and second lever arms to a pair of goggles.

31. The helmet of claim 16 further comprising:
first and second slotted lever arms coupled to said central shell at opposite sides thereof such that said lever arms are slideable along the lengths of said slots;
first and second elastic means connected to said first and second slotted lever arms, respectively, and to said central shell for biasing said first and second lever arms generally towards the posterior of said central shell; and
means for connecting said first and second lever arms to a pair of goggles.

32. The helmet of claim 31 wherein said hearing defender assembly and said goggle assembly are operable completely independently of each other.

33. The helmet of claim 32 further comprising a microphone assembly comprising:
a microphone boom connected to one of said lateral electronics enclosures;
a microphone connected to said microphone boom;
said microphone boom being selectively positionable between utilization and standby positions without interference from and completely independently of said goggle mount assembly and said goggle assembly.

34. The helmet of claim 33 further comprising a chin cup assembly comprising:
a pair of suspension cords each being connected at first and second ends to one of said lateral electronics enclosures;
a chin strap connected to said first cord; and
a chin strap fastener means for connecting said chin strap to said second cord.

35. In a protective helmet including a helmet shell for protecting the head of the wearer, the improvement comprising a goggle mount assembly comprising:
first and second slotted lever arms coupled to said helmet shell at opposite sides thereof such that said lever arms are slideable along the lengths of said slots;
first and second elastic means connected to said first and second slotted lever arms, respectively, and to said helmet shell for biasing said first and second lever arms generally towards the posterior of said helmet shell; and
means for connecting said first and second lever arms to a pair of goggles.

36. In the protective helmet of claim 35 the improvement further comprising:
said helmet shell having a central shell and first and second lateral helmet sections connected to said central shell and defining first and second apertures between said central shell and said first and second lateral helmet sections;
said first and second slotted lever arms extending through said first and second apertures, respectively.

37. The protective helmet of claim 36 wherein:
said first and second slotted lever arms are selectively positionable between utilization and standby positions and wherein said first and second elastic means exert tension on said goggles to secure said goggles against the face of the wearer when said first and second lever arms are in said utilization position and further wherein said first and second elastic means exert tension on said goggles to secure them against said central shell when said first and second lever arms are in said standby position.

38. The protective helmet of claim 37 wherein each of said first and second elastic means comprises:
a clevis member connected to a respective one of said first and second slotted lever arms; and
an elastic cord connected to said clevis member and to said central shell.

39. The protective helmet of claim 38 wherein said first and second slotted lever arms are coupled to said central shell by first and second mounting pins, respectively, said mounting pins being connected to said central shell and extending through the respective slots of said first and second slotted lever arms such that said first and second slotted lever arms are rotatable around their respective mounting pin.

40. In a protective helmet including a central shell and a pair of lateral helmet sections, the improvement comprising a hearing defender assembly comprising:
a pair of hearing defenders;
spring means connected to said pair of hearing defenders for biasing said hearing defenders towards the ears of the wearer; and
hinge means connected to said central shell and to said spring means for enabling selective positioning of said pair of hearing defenders alternatively over the ears of the wearer or at rest against said pair of lateral helmet sections or at rest, off of said helmet away from said pair of lateral helmet sections so as to permit removal of said pair of lateral helmet sections.

41. The helmet of claim 40 wherein said spring means comprises a single curved band.

42. The helmet of claim 41 wherein said lateral helmet sections comprise compartments for containing communications equipment.

43. The helmet of claim 42 wherein said single curved band is a metallic band.

44. The helmet of claim 42 wherein said spring means exerts no tension on either said central shell sections or said pair of lateral helmet sections.

45. The helmet of claim 43 wherein said hinge means is connected to said central shell at the posterior portion thereof.

46. The helmet of claim 2 further comprising a nape cushion secured to said pair of lateral enclosures rear portions.

* * * * *